United States Patent [19]

Dollison

[11] Patent Number: 4,680,930

[45] Date of Patent: Jul. 21, 1987

[54] HYDRAULIC CONTROL CIRCUIT AND VALVE ASSEMBLY

[75] Inventor: William W. Dollison, Dallas, Tex.

[73] Assignee: Otis Engineering Corporation, Dallas, Tex.

[21] Appl. No.: 558,050

[22] Filed: Dec. 5, 1983

[51] Int. Cl.[4] ..... F15B 15/18

[52] U.S. Cl. ..... 60/375; 60/369; 60/486; 91/288; 91/306; 91/311; 91/314

[58] Field of Search ..... 60/369, 371, 388, 392, 60/486, 470, 472, 413–416, 375; 91/286, 288, 304–306, 311, 314

[56] References Cited

U.S. PATENT DOCUMENTS

| | | | |
|---|---|---|---|
| 4,198,820 | 4/1980 | Roth et al. | 60/369 |
| 4,381,695 | 5/1983 | Ogles | 60/369 |
| 4,491,055 | 1/1985 | Dollison | 60/381 |
| 4,503,752 | 3/1985 | Olson et al. | 60/369 |

*Primary Examiner*—Edward K. Look

*Attorney, Agent, or Firm*—H. Mathews Garland

[57] ABSTRACT

A hydraulic power and control system for operating a reciprocating hydraulic mechanism including pump means connected to the hydraulic mechanism, a continuous torque hydraulic motor, a direction control driven by the motor to sequentially direct hydraulic power fluid to separate inlets of the mechanism, an escapement for restraining the motor at 180° intervals of rotation for sequentially holding the direction control at two separate positions, one for supplying one inlet and the other for supplying the other inlet of the mechanism, and hydraulic limit valves for controlling the escapement when a reciprocating member of the mechanism reaches the end of each stroke. One embodiment has two constant volume hydraulic pumps connected with the hydraulic mechanism through a reversing valve assembly operated by a scotch yoke connected with the escapement. Another embodiment has a reversible variable volume hydraulic pump controlled by an operating link coupled to a cam follower operating in a continuous cam groove of a rotary cam connected with the escapement. Also disclosed is an acceleration and deceleration control valve assembly including the escapement, the continuous torque motor, pilot piston control assemblies for the escapement, the scotch yoke mechanism, and the reversing valve from the hydraulic pumps.

30 Claims, 12 Drawing Figures

HYDRAULIC CONTROL CIRCUIT AND VALVE ASSEMBLY

This invention relates to hydraulic control circuits and valve assemblies for operating and controlling hydraulic reciprocating devices.

Control logic, both electronic and hydraulic, for operating reciprocating hydraulic devices such as power pistons in well pumps and devices for housing cylindrical work pieces, is expensive, complicated, and often difficult to maintain and operate. It is therefore a principal object of the invention to provide new and improved operating systems for hydraulic reciprocating apparatus which may be manufactured and maintained at lower cost than presently available systems.

It is another object of the invention to provide a hydraulic control circuit which controls the direction of movement of the piston in a hydraulic cylinder/piston assembly and additionally controls the acceleration and deceleration of the piston.

It is another object of the invention to provide a hydraulic power and control circuit for operating a reciprocating member such as a chain or rack and pinion driven by a hydraulic motor.

It is another object of the invention to provide a hydraulic reversing and acceleration and deceleration mechanism which includes a continuous torque fluid motor, an escapement for restraining the motor at selected positions, pilot apparatus for operating the escapement responsive to selected positions of a controlled hydraulic apparatus, a fluid valve for fluid flow control to the controlled apparatus, and operator means coupling the motor to the fluid valve.

It is another object of the invention to provide hydraulic control circuitry which does not include electronic components.

It is another object of the invention to provide a hydraulic control circuit which utilizes a continuous torque motor and escapement apparatus.

In accordance with the invention, a hydraulic power and control system for operating a hydraulic reciprocating device includes a hydraulic power fluid source, a fluid direction controller for selectively directing power fluid to the reciprocation device to operate the device between first and second positions in each of two directions, a reverser for moving the direction controller between first and second operating positions, a continuous torque fluid motor connected with the reverser, an escapement for restraining the motor to hold the direction controller at the two operating positions and for releasing the motor to move the controller between the two positions, and pilot sensors for operating the escapement to release the motor for moving the direction controller between the first and second position responsive to arrival of the reciprocating device at each of first and second positions. In one embodiment, the power fluid source is two pumps, one pump for driving the reciprocating device in one direction, and the other pump for driving the reciprocating device in the other direction. In another embodiment the power fluid source is a single variable volume reversible pump. Further, in accordance with the invention, the direction controller, the reverser, the escapement, and the continuous torque motor are packaged in a single unit.

The foregoing objects and advantages of the present invention will be better understood from the following detailed description of specific embodiments thereof taken in conjunction with the accompanying drawings wherein.

Figure 1:
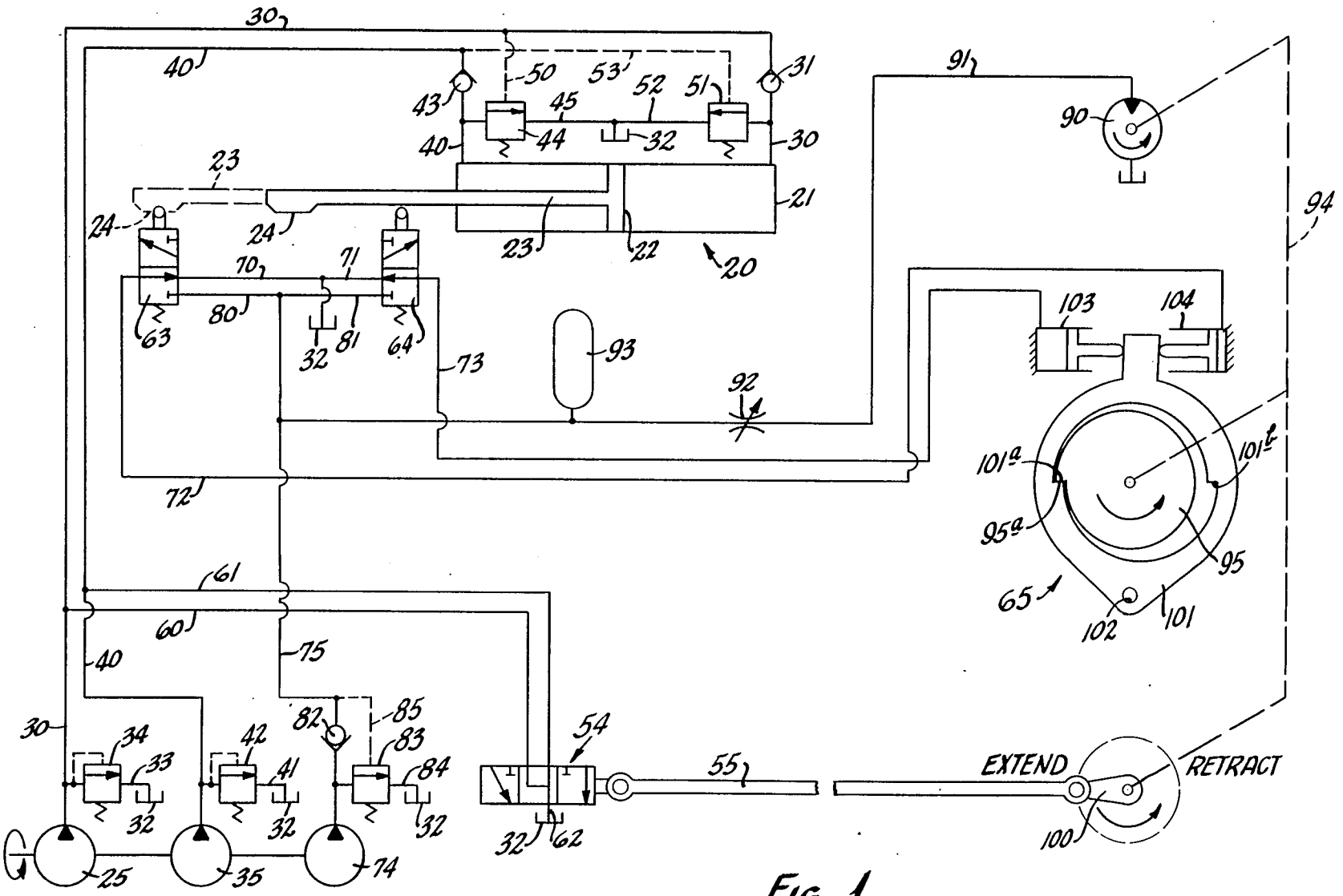
FIG. 1 is a schematic diagram of a hydraulic piston and cylinder assembly connected with one form of control system embodying the invention.

Referring to FIG. 1, a hydraulic piston assembly 20 operated by the control system of the invention comprises a cylinder 21, a piston 22, and a piston rod 23. A cam 24 is mounted on the free end of the piston rod 23. A fixed volume pump 25 is connected by a flow line 30 through a check valve 31 into the head end of the cylinder 21. The check valve 31 allows flow through the line 30 only in the direction into the head end of the cylinder 21. A reservoir schematically represented by the reference numeral 32 is connected with the suction side of the pump 25 by a pump intake line, not shown. A pressure relief line 33 including a relief valve 34 is connected from the line 30 on the discharge side of the pump 25 into the tank 32 for recirculating hydraulic fluid from the pump 25 back to the tank when the pressure in the line 30 exceeds a predetermined value. A second constant volume pump 35 is connected on the discharge side of the pump through a line 40 into the rod end of the cylinder 21. A return line 41 including a relief valve 42 is connected between the tank 32 and the line 40 on the discharge side of the pump 35 for relieving pressure above a predetermined value in the line 40 and recirculating the hydraulic fluid back to the tank 32. A check valve 43 is included in the line 40 permitting flow in the line 40 only into the rod end of the cylinder 21 from the pump 35. A sequence valve 44 is connected in a line 45 leading to the tank 32 from the line 40 between the check valve 43 and the rod end of the cylinder 21. The sequence valve operates in response to the pressure in the line 30 communicating through the line 50 connected from the line 30 into the sequence valve. When the pressure in the line 30 from the pump 25 is raised to a predetermined level at which the sequence valve is set to open, the sequence valve allows return flow from the rod end of the cylinder 21 as fluid is pumped through the line 30 into the head end of the cylinder permitting the piston to move through the extend stroke. Similarly, a sequence valve 51 is connected in a line 52 running from the tank 32 into the line 30 between the check valve 31 and the head end of the cylinder 21. The sequence valve 51 is operable in response to the pressure in the line 40 communicated to the sequence valve through a line 53 extending from the sequence valve into the line 40 upstream from the check valve 43. The sequence valve 51 opens in response to a predetermined pressure in the line 40 as the pressure in the line 40 is increased to move the piston in the retract direction. Control of the delivery of hydraulic fluid from the pumps 25 and 35 to the piston assembly 20 is controlled by a three-position valve 54 operated by a link 55. The valve 54 is connected with the hydraulic fluid lines 30 and 40 by parallel separate lines 60 and 61, respectively. The valve 54 communicates through a line 62 back to the tank 32. When the valve 54 is at the central or middle position as illustrated in FIG. 1, both of the lines 30 and 40 communicate through the valve 54 and the line 62 into the tank 32 so that fluid from both the pumps 25 and 35 is recirculated to the tank and thus the piston assembly 20 is not operated at this position of the valve 54. When the valve 54 is moved by the link 55 to the left end position, flow in the line 60 is blocked while the line 61 is communicated to the tank 32. With flow in the line 60 blocked, the pressure from the pump 25 through the line 30 is directed into the head end of the cylinder 21 to move the piston assembly through the extend stroke. When the valve 54 is shifted to the right end position, as represented in FIG. 1, the line 61 is blocked while the line 62 is communicated to the tank 32. With the line 61 blocked, pressure is delivered from the pump 35 through the line 40 into the rod end of the piston assembly for operating the piston through the retract stroke.

As illustrated in FIG. 1, a pair of limit valves 63 and 64 are mounted in spaced relation for engagement by the cam 24 on the piston rod 23 at the ends of the extend and retract strokes of the rod. The limit valves 63 and 64 control the operation of an escapement 65 which in turn controls the operation of the link 55 for moving the valve 54 between the three positions of the valve to operate the piston assembly. The valves 63 and 64 are two-position valves, each spring biased at first positions to communicate with the tank 32 through lines 70 and 71 leading from the valves 63 and 64, respectively, to the tank. The valve 63 communicates through a line 72 with the escapement 65. Similarly, the valve 64 communicates through a line 73 with the escapement 65. A third fixed volume pump 74 discharges through a line 75 leading to branch lines 80 and 81 connected with the valves 63 and 64, respectively, for supplying hydraulic fluid through the limit valves to operate the escapement. A check valve 82 in the line 75 permits flow only in a direction from the discharge of the pump 74 toward the valves 63 and 64. An unloading valve 83 is connected in a line 84 leading from the line 75 between the pump 74 and the check valve 82 for recirculation of fluid from the pump 74 to the tank when the pressure in the line 75 exceeds a predetermined level as sensed by a pilot line 85 from the line 75 downstream of the check valve 82 into the relief valve 83. The pump 74 also supplies pressure for operation of a continous torque fluid motor 90 which drives a link 55 as controlled by the escapement 65. The motor 90 is connected by a line 91 through a flow control valve 92 into the line 75 from the discharge of the pump 74. An accumulator 93 connects into the line 91 upstream from the valve 92.

The motor 90 drives a shaft 94 rigidly connected with a cam 95 in the escapement 65 and a crank 100 connected with the link or pitman arm 55 for operating the valve 54. The cam 95 operates within an index plate 101 pivotally mounted on a shaft 102. The index plate is operated on the shaft 102 between cam indexing positions by indexing piston assemblies 103 and 104. The indexing piston assembly 103 is connected through the hydraulic line 73 to the limit valve 64 for operation by the limit valve. Similarly, the indexing piston assembly 104 is connected by the hydraulic line 72 with the limit valve 63 for operation by the limit valve. The index plate 101 has stop surfaces **101*a* and 101*b* spaced 180 degrees apart within the plate for engagement by an indexing stop surface 95*a* on the cam 95 to restrain the cam at two positions of rotation spaced 180 degrees apart. The indexing plate 101 is shifted by the indexing piston assembly 103 to the position shown in FIG. 1 at which the cam index surface 95*a* is engaged to restrain the cam by the index plate surface 101*a*. Similarly, the indexing piston assembly 104 pivots the index plate 101 on the shaft 102 in a counterclockwise direction to position the index surface 101*b* for engagement by the cam index surface 101*a* for restraining the cam 95 after rotation in a counterclockwise direction 180 degrees from the position shown in FIG. 1. One particular form of escapement and control valve unit embodying the invention is illustrated in FIGS. 2–10, inclusive, comprising the motor 90, the escapement 65 and the valve 54**. Such unit will be described in detail hereinafter.

The operation of the piston assembly 20 for driving such apparatus as a sucker rod pump for producing an oil well may be effected and controlled by the system shown in FIG. 1. The operation of the system in FIG. 1 is shown at an interim stage at which the piston assembly 20 is operating to extend the piston rod 23 and thus the piston 22 is moving to the left as viewed in the drawing. The pump 74 delivers a constant volume of hydraulic fluid through the line 75 to the valves 63 and 64 and through the line 91 to the fluid motor 90 which is maintained under a condition of continuous torque. The shaft 94 secured with the continuous torque motor 90 and the cam 95 is restrained against rotation by engagement between the surface **101*a* of the index plate 101 with the cam surface 95*a* on the cam 95. In this state of the escapement 65 the crank 100 on the shaft 95 connected with the arm 55 has positioned the valve 54 to the left end of its movement at which the line 60 is blocked and line 61 is communicated through the valve 54 to the tank 32. The fluid discharge from the pump 35 is circulated from the pump through the lines 40 and 61 back to the tank 32. The hydraulic fluid from the pump 25, however, is directed through the line 30 and the check valve 31 into the cap end of the cylinder 21 applying a force to the piston 22 to extend the piston and piston rod 23 toward the left as shown in FIG. 1. The pressure in the line 30 is communicated through the pilot line 50 into the sequence valve 44 holding the valve open so that hydraulic fluid in the rod end of the cylinder is displaced along the line 40 between the cylinder and the check valve 43 and across through the valve 44 and the line 45 back to the tank 32. It will be obvious that for the piston 22 to move in a rod extending direction toward the left, pressure in the cap end of the cylinder 21 from the line 30 must force the piston 22 in an extended direction while the fluid in the rod end of the cylinder must be allowed to flow from the cylinder back to the tank along the path just described. During the movement of the piston 22 and rod 23 between end limits, the limit valves 63 and 64 are at positions communicating the lines 72 and 73 with the tank 32 so that there is no pressure on the indexing piston assemblies 103 and 104 and thus the escapement 65 remains as shown in FIG. 1. When the piston 22 and rod 23 reach the end of the extend stroke, the cam 24 on the rod engages the limit valve 63 shifting the valve to communicate the line 80 with the line 72 so that the accumulator 93 unloads applying pressure to the indexing piston assembly 104. The piston and rod of the assembly 104 extend pivoting the index plate 101 on the shaft 102 in a counterclockwise direction moving the index plate stop surface 101***a* away from the cam stop surface 95*a*. When the index plate releases the cam, the continuous torque motor 90, being free to now rotate, turns the shaft 94 in a counterclockwise direction as viewed in FIG. 1 rotating the crank 100 pulling the arm 55 back to the right shifting the valve 54 to the right end position when the crank, shaft 94 and cam 95 have rotated 180 degrees. The index plate 101 is shifted on the shaft 102 by the piston assembly 104 until the plate stop surface 101*b* lies in the path of rotation of the cam surface 95*a*. The cam surface 95*a* is rotated into engagement with the index plate stop surface again restraining the motor 90, shaft 94, cam 95, and the crank 100 with the arm 55. The valve 54 is now at the right end position at which the line 61 is now blocked while the line 60 is connected through the valve 54 to the tank 32. With the line 61 blocked, pressure from the pump 35 is applied through the line 40 and check valve 43 into the rod end of the cylinder 21 applying hydraulic force in the cylinder to initiate movement of the piston 22 and rod 23 toward the right in a retract direction. The pressure in the line 40 is applied to the sequence valve 51 through the pilot line 53 opening the sequence valve so that hydraulic fluid in the cap end of the cylinder 21 may flow from the cylinder along the line 30 and through the sequence valve 51 and the line 52 into the tank 32 thereby relieving pressure in the cap end of the cylinder so that the pressure in the line 40 applied into the rod end of the cylinder may force the piston 22 and rod 23 in the retract direction.

As previously stated, during the times that the piston 22 and rod 23 are between stroke end limits, the limit valves 63 and 64 are at tank positions thereby opening the lines 72 and 73 to the tank 32 so that no pressure is on the indexing piston assemblies 103 and 104. At this position of the valves 63 and 64 the lines 80 and 81 connected from the line 75 into the valves are blocked and thus the pressure from the pump 74 recharges the accumulator 93 and continues to apply hydraulic pressure into the continuous torque motor 90.

As the piston 22 and the rod 23 reach the end of the retract stroke, the cam 24 engages the valve 64 moving the valve downwardly as viewed in FIG. 1 from the tank position to the second position of the valve communicating the line 81 with the line 73 so that the hydraulic pressure in the accumulator 93 unloads through the lines 91 and 81 through the valve 64 into the line 73 applying pressure into the indexing piston assembly 103 to extend the piston pivoting the index plate 101 clockwise on the shaft 102 to move the index plate back to the position shown in FIG. 1. As this procedural sequence occurs, the cam 95 is again released so that the oontinuous torque motor 90 may drive the shaft 94, the cam 95, and the crank 100 counterclockwise until the cam has rotated 180 degrees back to the position of FIG. 1 at which the index plate again restrains the cam, shaft, crank and motor. It will be recognized, of course, with the cam 95 back to the position of FIG. 1, the valve 54 is again shifted to the left end position for again applying hydraulic pressure into the cap end of the cylinder 21 to move the cylinder 22 and piston rod 23 through another extend stroke.

During each transition period between extend and retract strokes, during which time the continuous torque motor 90 is rotating the shaft 94, the rate at which the shaft rotates is controlled by the rate of hydraulic fluid flow to the motor 90 through the flow control valve 92. This transition rate in turn controls the flow rate at which the valve 54 recirculates hydraulic fluid from the pumps 25 and 35 back to the tank which in turn controls the rate at which the pumps deliver hydraulic fluid to the hydraulic piston assembly 20. Thus, the acceleration and deceleration of the piston 22 and rod 23 are controllable by the valve 92.

At any time during the operation of the hydraulic control system of FIG. 1, if the pressure in any of the hydraulic circuits supplied by the pumps 25, 35 and 74 exceeds a predetermined level for the circuit, the unloading or safety valve for the circuit opens to return fluid back to the tank 32. For example, hydraulic fluid pressure from the pump 25 in the line 30 is applied to the valve 34 through the pilot line leading to the valve from the line 30. If that pressure in the line 30 exceeds the predetermined value at which the valve is set to open, the pilot line pressure opens the valve 34 communicating the line 30 through the valve 34 and the return line 33 into the tank 32. The unloading or safety valves 42 and 83 operate in the same manner. It will be apparent that in the operation of the valve 54 during the transition between extend and retract strokes the valve 54 will be at a neutral position at which both the lines 60 and 61 are communicated back to the tank 32 so that hydraulic fluid flow from both the pumps 25 and 35 is back to the tank 32 rather than to either end of the hydraulic piston assembly 20.

It will be understood from the foregoing description of the operation of the apparatus of FIG. 1 that the hydraulic circuit of the invention controls both the direction of piston movement and the acceleration and deceleration of the piston at the stroke extremities.

Figure 2:
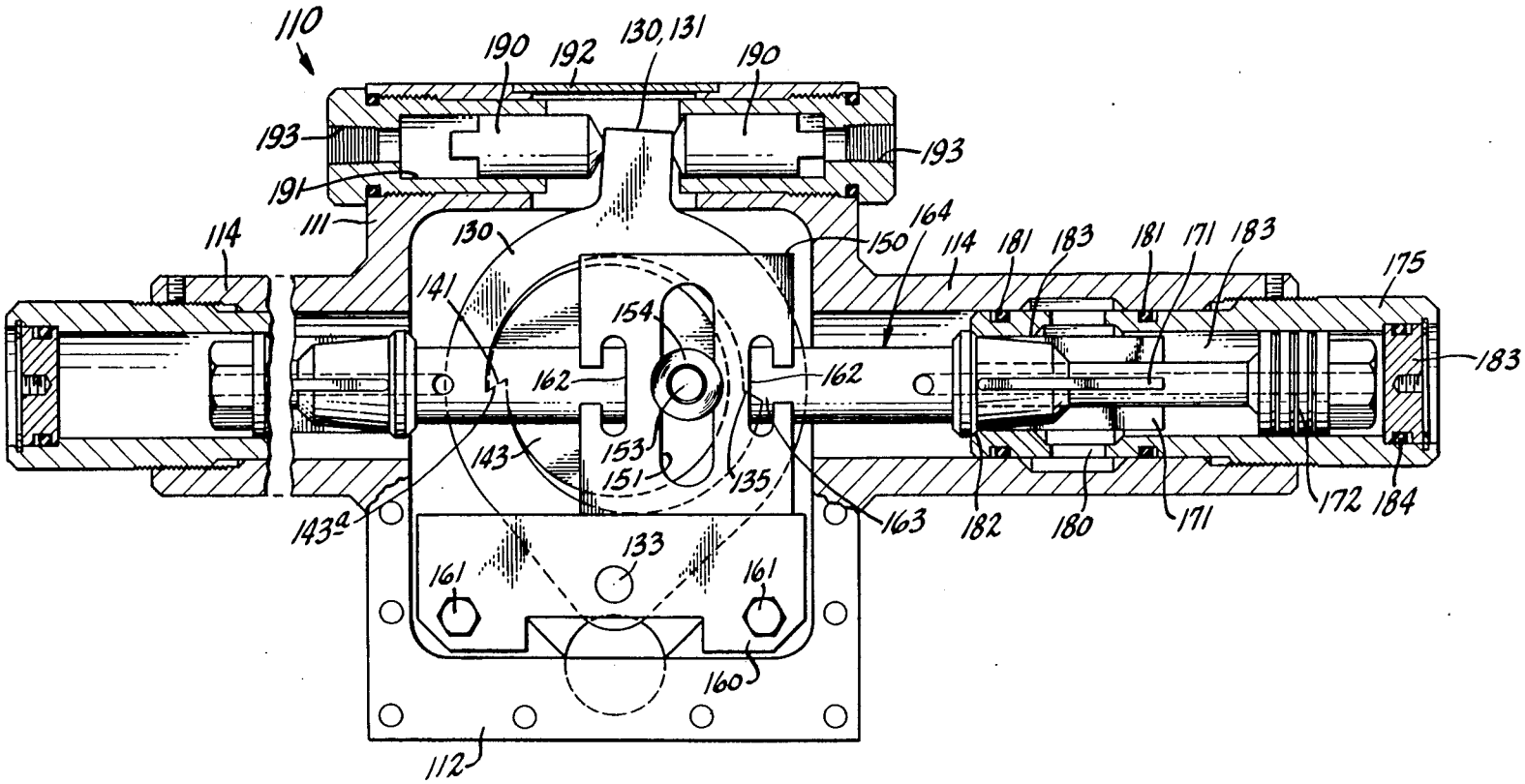
FIG. 2 is a longitudinal front view partially in section of an escapement and three-way valve assembly used in the control system of FIG. 1.
Figure 4:
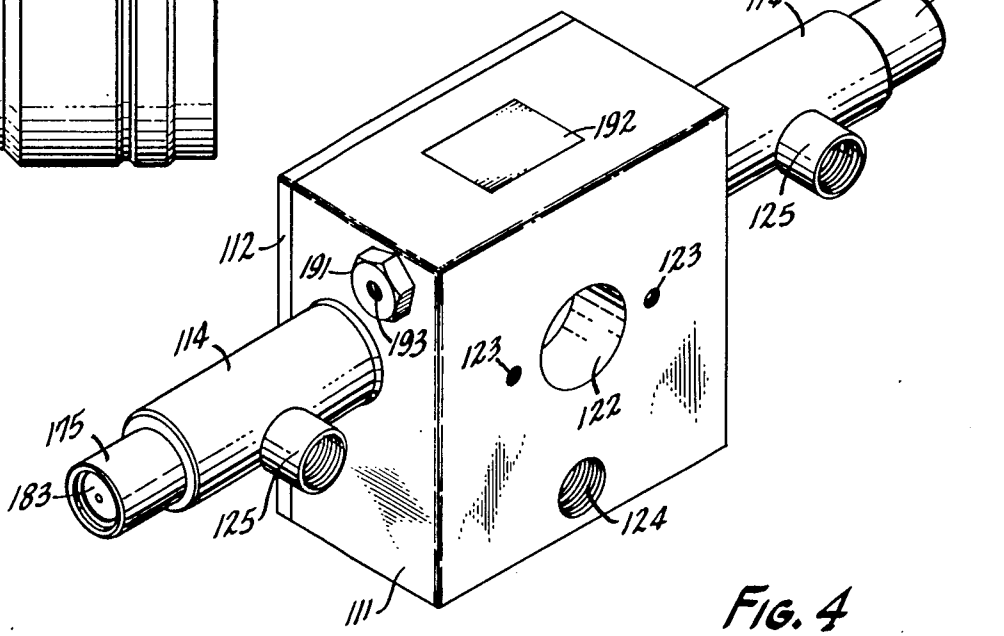
FIG. 4 is a back view in perspective of the escapement and valve device of FIGS. 2 and 3 with the motor removed.
Figure 3:
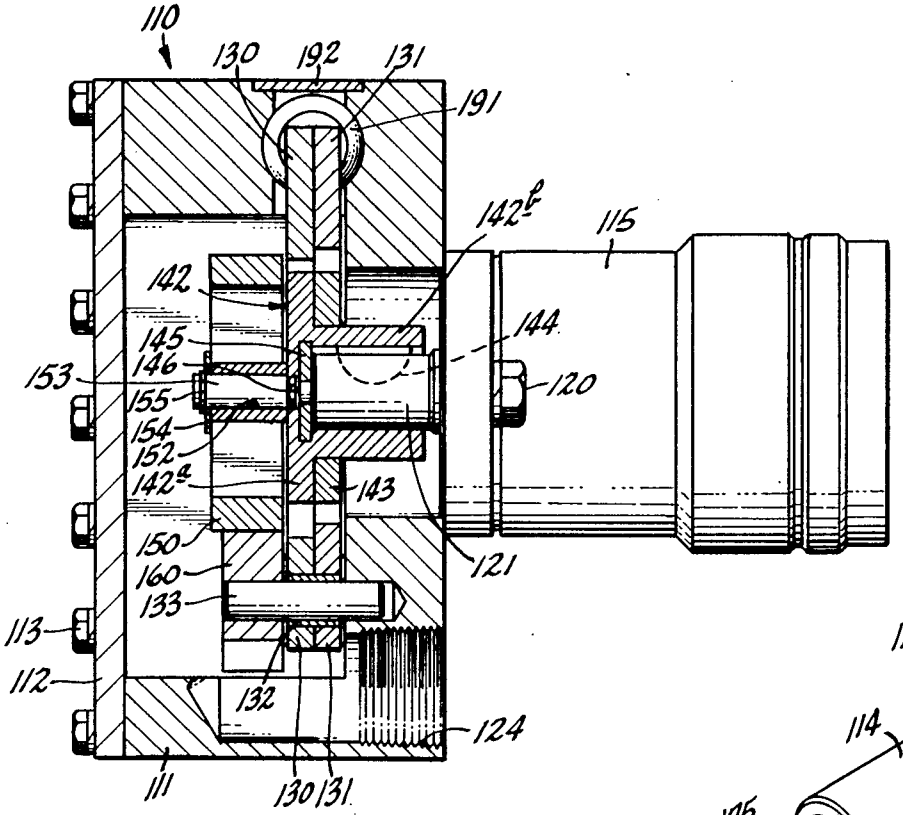
FIG. 3 is a side view in section and elevation of the device of FIG. 2 taken along the line 3—3 of FIG. 2.

A hydraulic control valve assembly 110 for controlling the operation of a piston assembly such as the assembly 20 in FIG. 1 is illustrated in FIGS. 2–10. The control valve assembly 110 combines the functional features of the continuous torque motor 90, the escapement 65, the crank 100 and arm 55, and the three-way valve 54. Referring to FIGS. 2–4, the assembly 110 has a rectangular central housing or body 111 provided with a front cover 112 secured to the body by a plurality of bolts 113. Tubular valve bodies 114 are formed integral with and extend laterally from opposite sides of the housing 111. A continuous torque hydraulic motor 115 is mounted by bolts 120 on the back face of the housing 111. The motor 115 corresponds with the motor 90 in the system of FIG. 1. The motor 115 has a shaft 121 corresponding with the shaft 94 of the system of FIG. 1. The shaft 121 extends into the housing 111 through a central opening 122 in the back face of the housing. The back wall of the housing is provided with internally threaded holes 123 on opposite sides of the opening 122 for the bolts 120 for mounting the motor 115 on the housing. The back of the housing also is provided with an internally threaded return flow port 124 which may be used for connection of the hydraulic return line 62 in the system of FIG. 1 for returning flow from the three-way direction control valve to the tank. Each of the valve bodies 114 has an internally threaded nipple opening into the valve body for connection of the valve assembly with the hydraulic pumps used for operating the main piston assembly. For example, in the system of FIG. 1 the pumps 25 and 35 would be connected into the valve bodies 114 by the lines 60 and 61, respectively, which would connect into the nipples 125 on the valve bodies on the opposite sides of the housing 111.

Figure 5:
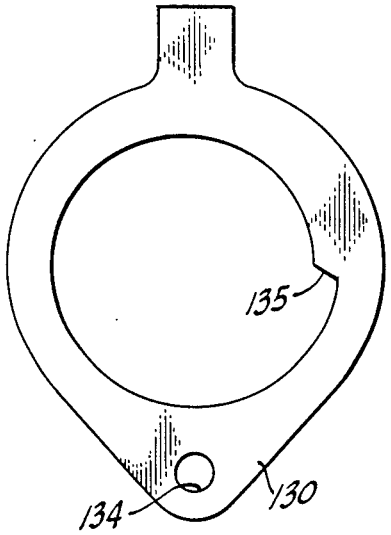
FIG. 5 is a front view in elevation of the front index plate of the escapement assembly.
Figure 6:
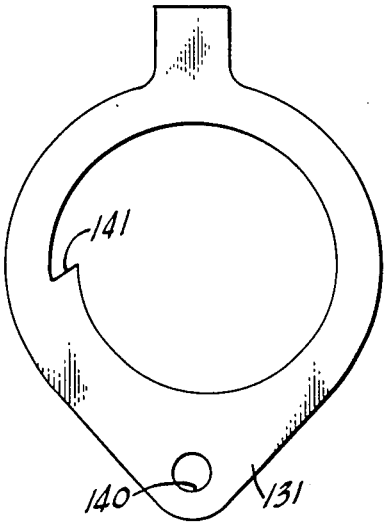
FIG. 6 is a front view in elevation of the rear index plate of the escapement.
Figure 7:
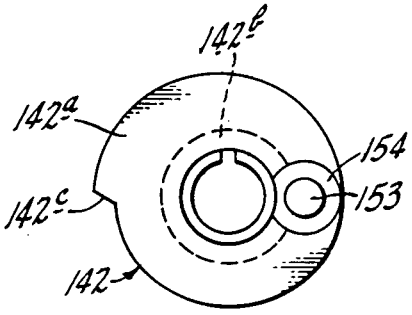
FIG. 7 is a front view in elevation of the crank and front stop cam of the escapement.
Figure 8:
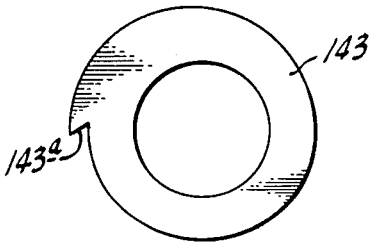
FIG. 8 is a front view in elevation of the rear stop cam of the escapement.
Figure 9:
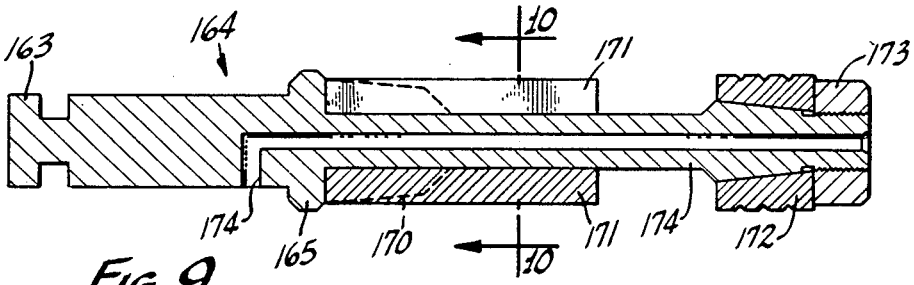
FIG. 9 is a longitudinal view in section and elevation of the right valve assembly of the escapement and valve device.
Figure 10:
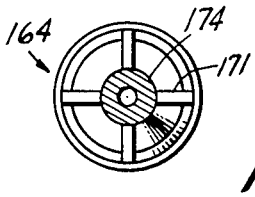
FIG. 10 is a view in section and elevation along the line 10—10 of FIG. 9.

Referring to FIG. 3 front and rear index plates 130 and 131 are pivoted on a bearing 132 secured on a shaft 133 pivotally mounting the index plates in the body. The index plates move together as a unit serving the function of the single plate 101 shown in FIG. 1. The shaft 133 corresponds with the shaft 102 of FIG. 1. The detailed design of the front index plate 130 is shown in FIG. 5. The plate has a hole 134 for pivotal mounting of the plate and a downwardly facing downwardly sloping stop surface 135 corresponding with the index plate stop surface 101*b* shown in FIG. 1. Similarly, the back index plate as shown in FIG. 6 has a bottom central hole 140 for pivotally mounting the plate on the shaft 133 and an upwardly facing downwardly and outwardly sloping stop surface 141 corresponding with the stop surface 101*a* of FIG. 1. On both the front and back index plates 130 and 131 the stop surfaces 135 and 141 are each in planes which are perpendicular to a line drawn from the surfaces to the axis of pivotal movement of the plates. Stated otherwise, a line drawn in the planes of surfaces 135 and 141 perpendicular to the axis of pivotal rotation of the index plates which is the axis of the holes 134 and 140 in the plates would be tangent to a circular arc intersecting the surfaces 135 and 141 drawn on the same axis of rotation of the plates through the holes 134 and 140. The plates 130 and 131 are mounted on the shaft 133 in superimposed relation operating as a unit to perform the cam latching functions of the index plate 101 in the system of FIG. 1. The surface 141 on the plate 131 restrains the cam when the plates are pivoted clockwise while the surface 135 on the plate 130 restrains the cam when the plates are pivoted in a counterclockwise direction. The functions of the cam 95 and the crank 100 in the system of FIG. 1 are performed in the valve assembly 110 by a front crank cam 142 and a rear cam 143 shown in assembled relationship in FIGS. 2 and 3 and individually in FIGS. 7 and 8. Referring to FIGS. 3 and 7, the crank cam 142 includes a front cam 142*a* and an integral tubular hub 142*b* which is mounted on the hydraulic motor shaft 121. A key 144 locks the hub on the shaft. A retainer 145 is held by a cap screw 146 screwed into the end of the shaft 121 holding the crank cam 142 on the shaft. Cam 142 has a stop surface 142*c* aligned to engage the index plate surface 135. The rear cam 143 fits on the hub 142*b* behind the front cam 142*a* and is welded to the hub so that the crank cam 142 and the rear cam 143 rotate as a unit on the shaft 121. The rear cam 143 has a stop surface 143*a* which is engageable with the index plate stop surface 141. As the front and rear cams 142*a* and 143 rotate as a unit, the index plates 130 and 131 pivot as a unit restraining the cam at the 180 degree intervals described with respect to the system of FIG. 1.

Operation of the three-way valve of the valve assembly 110 corresponding with the valve 54 in the system of FIG. 1 is performed by a scotch yoke arrangement including a cross plate 150, FIGS. 2 and 3. The cross plate is oscillated or reciprocated laterally by the crank cam 142. The cross plate has a central vertical slot 151 which receives a sleeve bearing 152 mounted on crankshaft 153 formed on the crank cam 142. The sleeve bearing is held on the crankshaft by a thrust washer 154 retained on the crankshaft by a lock ring 155. The bottom edge of the cross plate 150 slides along the top surface of a guide block 160 secured within and against the back wall of the housing 111 by bolts 161. The cross plate 150 oscillates laterally as the crankshaft 153 is turned by the crank cam 142. The cross plate operates the valves of the assembly 110 which perform the function of the three-way valve 54 in the system of FIG. 1. Opposite sides of the cross plate 150 are provided with vertical side opening latch slots 162 each of which is engaged by a latch head 163 on a cylindrical valve assembly 164, FIGS. 2, 9 and 10. Each of the valve assemblies 164 includes an annular poppet valve 165, a tapered surface 170 which acts as a metering pin, circumferentially spaced longitudinal guide vanes 171 and a piston 172 held on the valve by a nut 173. The valve body is provided with a flow passage 174 opening through the outer end of the valve body and radially through the body inward of the annular poppet valve 165 for balancing pressures outward of the piston 172 and inward of the poppet valve 165. Each of the valve assemblies 164 fits in sliding relation within a tubular valve seat 175 mounted within each of the lateral valve bodies 114 on opposite sides of the housing 111. Each of the tubular valve seats has circumferentially spaced side ports 180 communicating with the interior of the valve housing 114 aligned with the nipple 125, FIG. 4, in each of the housings 114. Longitudinally spaced ring seals 181 are mounted in annular recesses on the valve seats on opposite sides of the ports 180 for sealing between the valve seats and the inner wall surface of the valve housings 114. The inward end of the valve seat 175 is provided with a tapered seat surface 182 for sealing engagement with the poppet valve 165 in the valve seat. Each of the valve seats 175 has an internal tubular surface 183 extending from the valve seat surface 182 toward the outer end of each valve seat adjacent to the valve seat ports 180. The outer edges of the guide vane 171 on the valves 164 fit in sliding relation within the cylindrical valve seat surfaces 183 so that the valves 164 maintain proper alignment as the valves move back and forth between open and closed positions within the valve seats. The piston 172 on each of the valves 164 is slightly larger than the sealing area of the poppet valves 182 so that when each of the valves is closed, a fluid pressure force biases the valve toward its closed position. The piston 172 also functions to limit the force required to open each of the valves. When the control valve assembly 110 is connected in a hydraulic system such as illustrated in FIG. 1, each of the valve assemblies 164 communicates through its respective nipple 125 with the hydraulic lines 60 and 61 so that one of the valve assemblies 164 at open position permits the associated pump to dump to tank or reservoir and at closed position blocks the flow back to the tank and thus forces the hydraulic fluid to flow to the hydraulic piston assembly 20 operated by the system. For example, as shown in FIG. 2, the right valve assembly 164 is closed and thus the pump, 25 or 35, connected into the nipple 125 leading to the valve seat side ports 180 cannot pump back to tank and thus the fluid is forced to the end of the piston assembly 20 connected with the pump. On the other hand, when the valve assembly 164 is moved to the open position, see the left valve 164 in FIG. 2, hydraulic fluid may flow from the particular line, 60 or 61, leading to one of the pumps along the bore of the housing 114 around the poppet valve 182 into the housing 111 and out of the housing through the tank port 124 thus recirculating the fluid from the particular associated pump back to the reservoir. The tapered surface 183 along each of the valves 164 effects a metering condition in the hydraulic fluid flowing past each of the valves when each of the valves is between the full open and closed positions.

As shown in FIGS. 2 and 3, the housing 111 of the control valve assembly 110 has two identical hydraulic pistons 190 movable in opposite cylinders 191 secured across the top of the housing 111 on opposite sides of the index plates 130 and 131. An opening in the top of the housing 111 is closed by a plate 192. The pistons 190 and cylinders 191 perform pilot piston functions corresponding with the piston assemblies 103 and 104 shown in FIG. 1 for pivoting the index plates 130 and 131 in unison on the pivot pin 133 for alternately restraining the cams 142 and 143 at the 180 degree intervals of rotation previously described. In the system of FIG. 1 the lines 72 and 73 are connected into internally threaded ports 193 at the outward ends of each of the cylinders 191 for communicating one of the pistons 190 with the limit valve 63 and the other opposite piston 190 with the limit valve 64. The fluid motor 115, of course, is supplied with hydraulic fluid through the line 91 in the system of FIG. 1.

Operationally the control valve assembly 110 in a hydraulic system as illustrated in FIG. 1 provides the functions of the continuous torque motor 90, the index plate assembly 101 with the stop cam 95, the crank 100 with the pitman arm 55, and the three-way valve 54. Referring to FIGS. 3–10 in terms of the operation of the system of FIG. 1 the functions of the components of the control valve assembly 110 are as follows: motor 115 corresponds with motor 90; front and rear index plates 130 and 131 correspond with index plate 101; front and rear cams **142*a* and 143 correspond with cam 95; motor shaft 121 corresponds with shaft 94; the pilot pistons 190 and the cylinders 191 correspond with the piston assemblies 103 and 104; the crank features of the crank cam 142 with the cross plate 150 correspond with the crank 100 and the pitman arm 55; and the valve assemblies 164 correspond with the three-way valve 54. The position of the components of the control valve assembly 110 as shown in FIG. 2 are the same as those of the corresponding components of the system of FIG. 1. The left pilot piston 190 has pivoted the front and rear index plates 130 and 131 clockwise to a position at which the stop surface 143*a* on the cam 143 is engaged by the stop surface 141 on the index plate 131 thus restraining the crank cam 142 and the cam 143 along with the cross plate 150 against movement. At this position of the cross plate the right valve assembly 164 is closed. For purposes of describing the operation, the nipple assembly on the right back side of the control valve assembly 100 shall be considered as connected with the hydraulic pump 25 so that with the valve assembly 164 closed hydraulic fluid is forced from the pump 25 into the cap end of the cylinder 21 operating the piston 22 and rod 23 in the extend mode. Looking at FIG. 2, the poppet valve 182 of the valve assembly 164 is engaging the seat surface 182 so that flow cannot occur from the hydraulic pump 25 through the line 60 into the nipple 125 because of the closed poppet valve. The pump pressure within the valve housing 114 around the valve assembly 164 is effective along the valve assembly from the piston 172 at the right end to the line of sealing engagement between the poppet valve 165 and the seat 182 at the left end. Since the area of the piston 172 is slightly larger than that of the poppet valve, the valve assembly 164 is biaed in the valve-closed direction by the pump pressure. On the opposite left end of the control valve assembly 110 the valve assembly 164 is at the right end full open position so that flow from the other hydraulic pump 35 through the line 64 occurs freely inwardly along the nipple 125 into the left end, as in FIG. 2, of the valve housing 114, inwardly through the valve seat ports 180, along the tapered valve surface 170 past the poppet valve 165 within the seat surface 182 and inwardly into the housing 111 from which the flow continues outwardly in the port 124 of the valve housing along the line 62 back to the tank or reservoir 32. These hydraulic fluid flow directions and positions of the various components of the control valve assembly 110 remain fixed until the piston in the assembly 20 reaches the end of the extend stroke through which it is moving as shown in FIG. 1. At the end of the extend stroke the limit valve 63 is operated by the cam 24 applying hydraulic pressure in the line 72 to the right pilot piston 190 in the control valve assembly 110 as shown in FIG. 2. At this time the limit valve 64 in the system of FIG. 1 is communicating the left pilot system 190 with the tank and thus hydraulic fluid pressure in the right pilot piston 190 urges the piston in a left direction against the index plates 130 and 131 pivoting the plates on the pin 133 in a counterclockwise direction. As soon as the stop surface 141 on the index plate 131 moves along a circular arc counterclockwise and downwardly from the stop surface 143*a* on the rear cam 143, the cam 143 is released thereby no longer restraining the hydraulic motor 115, the motor shaft 121, with the crank cam 142 which are now rotated counterclockwise by the motor 115. As seen in FIG. 2, as the motor rotates counterclockwise, the crank 153 moves in a circular arc upwardly and to the left. As the crank 153 moves upwardly to the left, the cross plate 150 is moved to the left, the bottom edge of the cross plate sliding along the guide block 160. The leftward moving cross plate 150 pushes the left valve assembly 164 to the left toward the closed position while pulling the right valve assembly 164 to the left toward the open position. As the poppet valve 165 on the right valve assembly 164 moves away from the valve seat 182, flow begins from the hydraulic line connected with the nipple 125 opening into the right valve housing 114 and moves inwardly through the valve seat ports 180 and along the valve assembly 164 past the poppet valve flowing to the tank outlet 124 from the valve housing 111. The tapered surface 170 on the valve assembly 164 moves along the valve seat 182. The decreasing diameter of the tapered surface provides a metering effect increasing the flow in direct proportion to the rate at which the valve assembly 164 is moving. This rate, of course, is controllable by the speed at which the continuous torque motor 115 is turning which in turn is controlled by the setting of the valve 92 in the system of FIG. 1. Similarly, the tapered valve surface on the valve assembly 164 of the left valve is closing providing a metering effect in the shutting off of flow back to the tank from the left valve housing 114. This metering effect on the two valve assemblies 164 provides control of the acceleration and deceleration of the piston 22 in the hydraulic piston assembly 20 being controlled by the control valve assembly 110. The hydraulic motor 115 continues to rotate counterclockwise until the stop cam surface 142***c* on the crank cam 142 engages the stop surface 135 on the index plate 130, the index plates 130 and 131 having now been pivoted counterclockwise to a left position by the right-hand pilot piston 190. At this left position of the index plates the cams 142 and 143 are again restrained, the motor, shaft and cam having rotated counterclockwise 180 degrees. The full 180-degree movement shifts the cross plate 150 to the left end position fully closing the left-hand valve assembly 164 and fully opening the right-hand valve assembly 164. The rate of the simultaneous opening and closing of the valve assemblies 164 is dependent upon the rate of hydraulic fluid flow to the continuous torque motor 115 which powers the plate 150 through the scotch yoke coupling. The movement of the plate 150 and thus the valve assemblies 164 is directly proportional to the rate at which the motor 115 turns. In the system of FIG. 1 the rate at which the hydraulic motor turns is dependent upon the setting of the valve 92. As previously discussed, the rate of movement and the acceleration and deceleration of the valve assemblies 164 controls the hydraulic fluid flow from the pumps 25 and 35 which controls the operation of the piston assembly 20.

It will be evident from the foregoing description that the control valve assembly 110 including the scotch yoke valve operator mechanism controls both the acceleration and deceleration of the hydraulic piston assembly 20 as well as the changing of directions of the piston between the extend and retract strokes. The operative relationship between the cams 142 and 143 and the index plates 130 and 131 restrains the valve assemblies 164 during the time periods of the extend and retract strokes functioning at the end of each stroke to reverse the piston direction as well as to control the rate of acceleration and deceleration. The control is effected by metering the delivery from the hydraulic pumps, pumps 25 and 35 in FIG. 1, as the pumps deliver fluid alternately to the driven piston assembly 20 or recirculation back to the tank from the hydraulic circuit connected with the non-driving end of the hydraulic piston assembly during each stroke. The control provided by the control valve assembly 110 is effected through simple hydraulic mechanical means not requiring electrical or electronic controls. The system is less expensive to manufacture and more simple and cheaper to maintain and operate than presently available systems for performing the same functions. It will be noted that the alignment of the index plate and cam stop surfaces in planes perpendicular to lines drawn to the axis of rotation of the index plates minimizes the interference between the index plate stop surfaces and the cam stop surfaces as the index plates pivot from restraining positions to release positions. It will also be noted that the valve assemblies 164 in the control valve assembly 110 are slightly pressure biased closed and require minimum force to open due to the relation between the pistons 172 and the line of sealing between the valve 165 and the valve seat 182.

Figure 11:
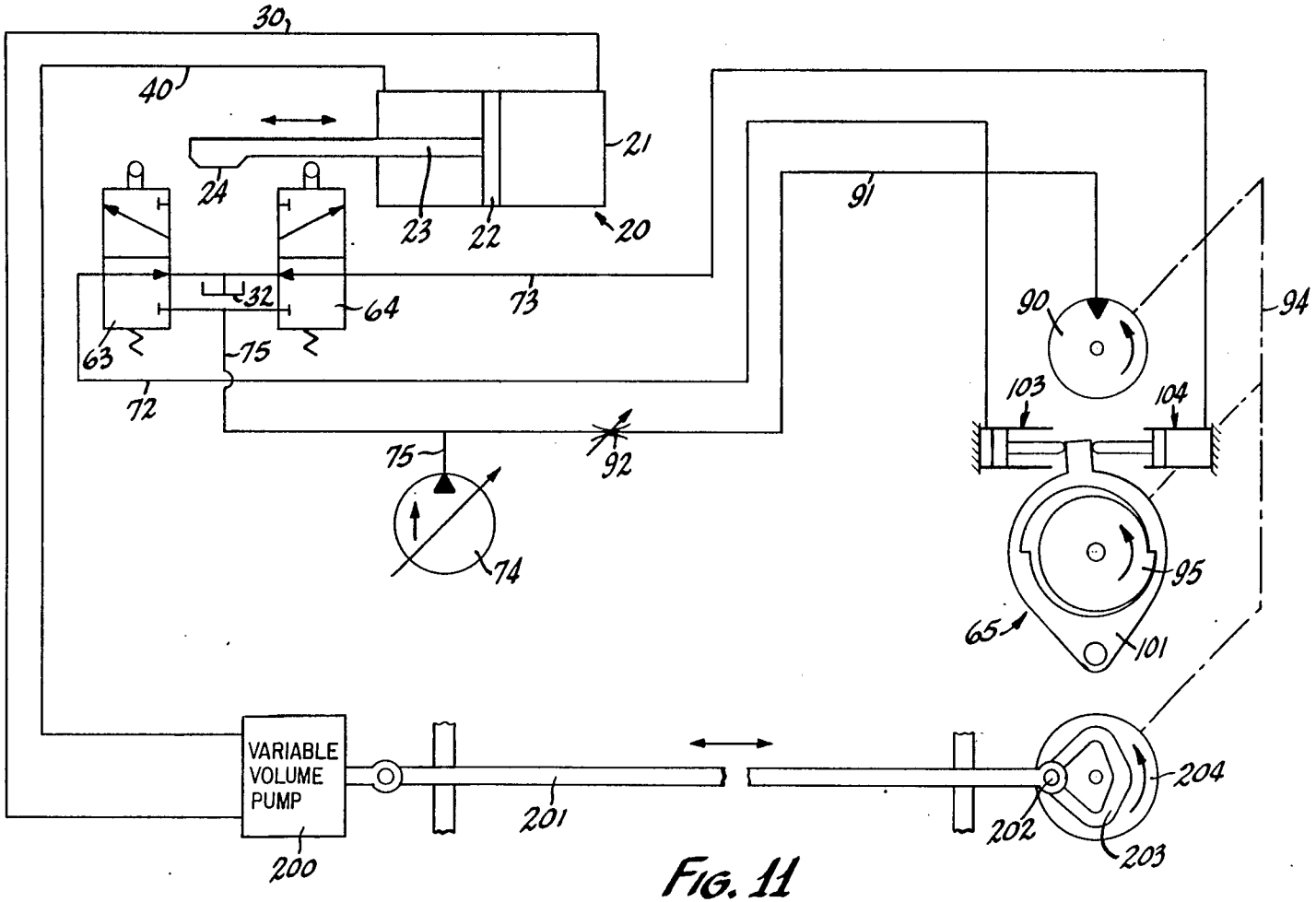
FIG. 11 is a schematic diagram of another form of hydraulic control for a piston assembly in accordance with the invention.

Another hydraulic system for operating a hydraulic piston assembly embodying features of the invention is illustrated in FIG. 11. The system of FIG. 11 differs from the system of FIG. 1 only in the substitution of a reversible variable volume pump for the two hydraulic pumps 25 and 35 in the system of FIG. 1 and in the use of a cam operated linkage to control the variable volume pump in place of the scotch yoke mechanism in the control valve assembly 110. The components of the system of FIG. 11 which correspond with the system of FIG. 1 are identified in FIG. 11 by the same reference numerals used in FIG. 1. Referring to FIG. 11, a variable volume reversible pump 200 is connected with the hydraulic lines 30 and 40 for supplying hydraulic fluid to the cap end and the rod end of the hydraulic piston assembly 20 for operating the piston assembly. A suitable pump is a series PVP pump manufactured by Double A Division of Brown and Sharp Manufacturing Company. Such pump includes a rotatable cylinder block driven by an input shaft and containing a plurality of piston assemblies in parallel axial relationship around the shaft controlled by an oscillating cam plate. The direction of operation and the pump displacement is controlled by varying the angular position of the cam plate. The pump 200 in FIG. 11 is coupled with an operating link 201 which varies the position of the cam plate in the pump. The link 201 is connected with a roller-type cam follower 202 which operates in a cam groove 203 in a rotary cam 204. The cam 204 is connected with the hydraulic motor shaft 94 which also drives the stop cam 95 controlled by the index plate 101 in the escapement 65. As discussed in connection with the system of FIG. 1, the pilot piston assemblies 103 and 104 pivot the index plate 101 for sequentially restraining the stop cam 95 at 180-degree rotational intervals at the ends of the extend and retract strokes providing for the reversal of the strokes of the piston assembly 20 and restraining the hydraulic motor 90 during each of the extend and retract strokes of the hydraulic piston assembly 20. The hydraulic continuous torque motor 90, the motor shaft 94, and the escapement 65 are incorporated in a control valve assembly essentially identical to the valve assembly 110 substituting the rotary cam 204 on the motor shaft 121 in place of the scotch yoke mechanism shown in FIG. 2. The rotary cam 204 is coupled directly on the front of the shaft 121 so that as the cams 142 and 143 are rotated by the shaft, the rotary cam 204 drives the link 201 through the cam follower 202 for changing the position of the cam plate in the pump 200. The operation of the system of FIG. 11 is identical to that of the system of FIG. 1 in all respects with the exception that in the system of FIG. 11 the hydraulic power fluid from the reversible variable volume pump 200 drives the cylinder assembly 20. The limit valve 63 and 64 are contacted by the cam 24 on the piston rod 23 as the piston 22 reaches the end of each extend and retract stroke. The limit valves control the operation of the pilot piston assemblies 103 and 104 in the escapement 65 pivoting the index plate 101 for sequentially restraining the cam 95 at 180° intervals of rotation of the shaft 94 by the motor 90. The shaft 94 as restrained and released by the index plate and cam turns the rotary cam 204 operating the cam follower 202 shifting the link 201 between end positions. At each of the opposite end positions of the link 201 the pump 200 delivers hydraulic fluid under pressure to one or the other of the cap and rod ends of the hydraulic piston assembly 20. The pump 74 delivers hydraulic fluid through the limit valves 63 and 64 to the constant torque motor 90 and the pilot piston assemblies 103 and 104 for operating the escapement 65 and the cam 204 with the link 201 to control the direction and volume of discharge of the pump 200 to the hydraulic piston assembly 20. The rate at which the cam 204 and link 201 changes the direction of operation of the pump 200 is a function both of the design of the cam groove 203 and the hydraulic fluid flow rate to the pump 90 as controlled by the valve 92.

The interchangeability of portions of the systems of FIGS. 1 and 11 will be readily recognized. While the system of FIG. 11 is described in terms of the reversible pump 200 being controlled by the circular cam 204, the link 201 may be connected to a scotch yoke cross plate such as the plate 150 in the apparatus 110 of FIG. 2 for controlling the pulp responsive to the escapement 65. Similarly in the system of FIG. 1 the link 55 may be operated by a cam system such as the circular cam 204 of FIG. 11 with the link 55 being coupled to the valve assemblies 164 for reversing the power fluid delivery to the cylinder 21 from the pumps 25 and 35. The valve assembly 110 provides a simple hydraulic-mechanical system for controlling the delivery of hydraulic power fluid to the cylinder for reversing and for controlling the acceleration and deceleration of the piston and piston rod.

Figure 12:
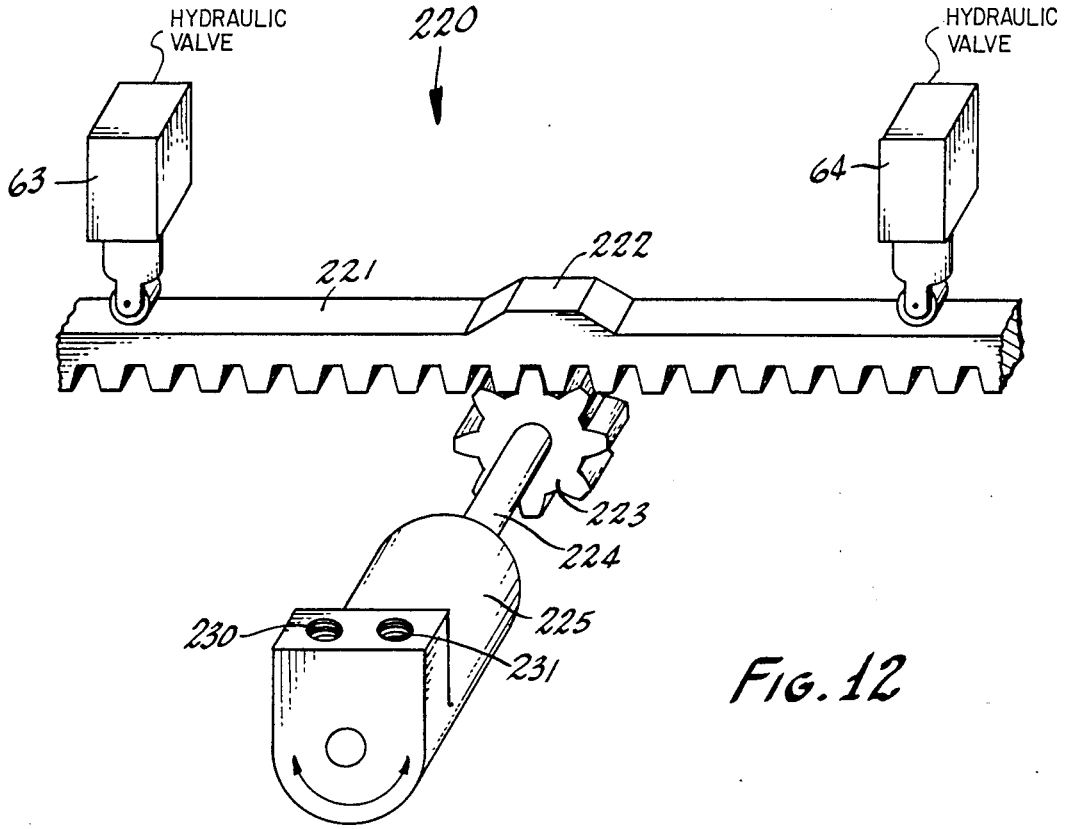
FIG. 12 is a reciprocating fluid motor driven rack and pinion operable by the system of the invention.

FIG. 12 shows a rack and pinion mechanism 220 which may be used for operating reciprocating apparatus such as a hone used in finishing the inside surface of a cylindrical member, not shown. A rack 221 including a cam 222 is driven by a pinion 223 on a shaft 224 of a hydraulic motor 225. The motor 225 has power fluid ports 230 and 231 for connection into a hydraulic power and control system of the type of either FIG. 1 or FIG. 11. One of the ports 230 and 231 serves as a hydraulic power fluid inlet while the other port is an outlet, depending upon the direction of rotation of the motor 225. The limit valves 63 and 64 of either of the systems of FIGS. 1 and 11 are mounted for contact by the rack cam 222. The distance between the limit valves determine the length of the reciprocating stroke of the rack. The motor 225 is reversed each time the cam 222 contacts one of the limit valves. For example, the motor may turn clockwise as seen in FIG. 12 driving the rack and cam toward the limit valve 64 until the cam 222 strikes the limit valve 64 releasing the escapement 65 which frees the continuous torque motor 90 to reverse the power fluid flow to the motor 225. The motor 225 than operates counterclockwise turning the pinion 223 to drive the rack toward the limit valve 63 until the cam 222 engages the valve 63, again reversing the motor 225. The hone, not shown, is connected with the rack 221 so that the hone is reciprocated by the rack. It will be apparent that any device which requires reciprocating movement along a defined path may be driven and controlled by the systems of the invention. As a further example, a circular gear with a cam, not shown, may be driven by the motor shaft 224. The valves 63 and 64 may be positioned to be contacted by the cam as the gear rotates, causing the motor 225 to be reversed producing reciprocating rotational motion.

What is claimed is:

1. A hydraulic power and control system for operating a hydraulic reciprocating mechanism comprising: hydraulic fluid supply means; fluid direction control means for selectively directing hydraulic fluid from said supply means to said reciprocating mechanism to reciprocate a member of said mechanism between a first position and a second position; said fluid direction control means having a first position directing hydraulic fluid to move said member in one direction and a second position directing hydraulic fluid to move said member in the other direction; reversing means for shifting said fluid direction control means between its first and second positions; a continuous torque hydraulic motor operatively connected to said reversing means; an escapement releasably coupled with said motor to restrain said motor from operating said reversing means while said member is intermediate said first and second positions; and means for releasing said motor from said escapement responsive to arrival of said member at said first and at said second positions allowing said motor to operate said reversing means and shift said fluid direction control means between said first position and said second position.

2. A hydraulic power and control system in accordance with claim 1 wherein said escapement includes stop cam means connected with and rotated by said motor, index plate means supported for engagement with said cam means for restraining said cam means at each of said first and second positions of said direction control means and releasing said direction and control means for movement between said positions, and pilot means for operating said index plate means relative to said cam means responsive to arrival of said member of said hydraulic mechanism at each of said first and said second positions of said member.

3. A hydraulic power and control system in accordance with claim 2 wherein said index plate pilot means comprises hydraulic piston means for moving said index plate means to cam engaging positions.

4. A hydraulic power and control system in accordance with claim 1 wherein said pump means comprises a first hydraulic pump for fluid delivery to said hydraulic reciprocating mechanism to operate said member in one direction and a second hydraulic pump for fluid delivery to said device to operate said member in the other direction, said direction control means comprises fluid valve means connected with said first and secord pumps for selectively directing fluid from said pumps to either said hydraulic mechanism or a fluid reservoir connected with the intakes of said pumps.

5. A hydraulic power and control system in accordance with claim 4 wherein said reversing means is a rotary cam having a continuous cam groove coupled with said hydraulic motor, a cam follower movable in said cam groove, and an operating link driven by said cam follower and connected to said direction control means.

6. A hydraulic power and control system in accordance with claim 4 wherein said reversing means is a scotch yoke assembly connected between said hydraulic motor and said direction control means.

7. A hydraulic power and control system in accordance with claim 1 wherein said pump means comprises a reversible variable volume pump having a control plate coupled with said reversing means.

8. A hydraulic power and control system in accordance with claim 7 wherein said reversing means is a rotary cam having a continuous cam groove, a cam follower mounted in said cam groove, and an operating link connected between said cam follower and said pump control plate.

9. A hydraulic power and control system in accordance with claim 8 wherein said reversing means is a scotch yoke assembly connected between said motor and said control plate of said pump.

10. A hydraulic power and control system in accordance with claim 1 wherein said direction control means, said reversing means, and said hydraulic motor comprise a control valve assembly further including a shaft driven by said motor, a stop cam on said shaft having a latch surface thereon, an index plate mounted for movement relative to said stop cam and having spaced latch surfaces for engaging said cam latch surface at positions of rotation of said stop cam corresponding with said first and second positions of said fluid direction control means for restraining said stop cam which said member is intermediate said first and second positions and for releasing said stop cam to rotate for operating said reversing means, pilot pistons for engaging and operating said index plate between cam engaging positions and cam release positions responsive to arrival of said member at said first and second positions of said member, and said reversing means is connected with said motor shaft for reversing said direction control means when said cam is released and for holding said direction control means at one of said first and second positions when said stop cam is restrained by said index plate.

11. A hydraulic power and control system in accordance with claim 10 wherein said reversing means is a rotary cam having a continuous cam groove, a cam follower in said cam groove, and an operating arm connected between said cam follower for operating said direction control means.

12. A hydraulic power and control system in accordance with claim 10 wherein said reversing means is a scotch yoke assembly including a crank shaft on said stop cam, a cross plate coupled with said crank shaft for reciprocating movement as said stop cam rotates, and said direction control means is coupled with said cross plate.

13. A hydraulic power and control system in accordance with claim 12 where said direction control means comprises valve means opened and closed by said cross plate and connectible between said pump means and a fluid reservoir for selectively controlling discharge of hydraulic fluid from said pump means to said hydraulic mechanism on said reservoir.

14. A hydraulic power and control system in accordance with claim 13 wherein said stop cam comprises first and second cams in superimposed relation each having a stop surface thereon for engagement by said index plate to restrain said cam at 180° intervals of rotations and said index plate comprises first and second superimposed plates having aligned openings therein for receiving said stop cam and said first and second plates each having a stop surface engageable with the stop surfaces on the first and second cams, respectively, said index plate stop surface being spaced 180° apart.

15. A hydraulic power and control system in accordance with claim 13 wherein said index plates are mounted for pivotal movement on a single pin and said stop surfaces on said index plates are aligned in planes perpendicular to a line drawn from said planes to the axis of pivotal movement of said index plates.

16. A hydraulic power and control system for operating hydraulic reciprocating mechanism comprising: a reservoir for hydraulic power fluid; a first hydraulic pump having a discharge line connected with one inlet of said hydraulic mechanism for operating said mechanism in a first direction; a return line from said first pump discharge line to return power fluid to said reservoir when said mechanism is operating in a second direction; a second hydraulic pump having a discharge line connected with a second inlet of said hydraulic mechanism for operating said mechanism in said second direction; a return line connected from said second pump discharge line for recirculating power fluid to said reservoir when said mechanism is operating in said first direction; a direction control valve connected between said reservoir and said discharge lines from said first and second pumps for selectively recirculating power fluid to said reservoir from one of said first and second pumps while the other of said pumps is delivering power fluid to said hydraulic mechanism; reversing means connected with said direction control valve for changing said valve between first and second positions to change said directions of operation and holding said valve in one of said positions while said hydraulic mechanism is operated in one of said directions; a continuous torque hydraulic motor; a control shaft connected between said hydraulic motor and said reversing means; a third hydraulic pump having a discharge line connected with said hydraulic motor for supplying power fluid to said motor; a control valve in said discharge line from said third pump to control the flow rate of hydraulic fluid to said hydraulic motor; an escapement connected with said hydraulic motor shaft for restraining said shaft against rotation at 180° intervals of rotation at which said reversing means and said direction control valve are sequentially positioned for directing power fluid from said first and second pumps to said hydraulic mechanism for operating said mechanism in said first and second directions; first and second pilot piston assemblies operable with said escapement for moving said escapement to restrain said motor shaft at each of said 180° spaced positions of rotation; a first two position limit valve connected with said third hydraulic pump and with one of said pilot piston assemblies for operating said escapement responsive to said hydraulic mechanism reaching a first position; and a second limit valve connected with said third hydraulic pump and the other of said pilot piston assemblies for operating said escapement responsive to said mechanism reaching a second position.

17. A hydraulic system in accordance with claim 16 wherein said reversing means is a scotch yoke mechanism having a cross plate provided with an elongated slot, a crank pin mounted on said stop cam extending through said cross plate slot for reciprocating said cross plate responsive to circular motion of said crank pin, a guide block mounted for sliding engagement by said cross plate along an edge of said plate perpendicular to said slot in said plate for holding said plate as said plate is reciprocated by said crank pin, and means connecting said cross plate with said direction control valve for moving said direction control valve to opposite end positions corres ponding with opposite end positions of said cross plate.

18. A hydraulic mechanism in accordance with claim 17 wherein said direction control valve comprises first and second valve assemblies coupled with said cross plate for controlling flow between said first and second hydraulic pumps and said hydraulic mechanism, each of said valve assemblies having a poppet valve portion for metering flow between said one of said first and second hydraulic pumps connected with said valve assembly and said reservoir for controlling acceleration and deceleration of said hydraulic mechanism.

19. A hydraulic system in accordance with claim 18 wherein said hydraulic motor, said escapement, said pilot piston assemblies operating said index plate of said escapement, said scotch yoke mechanism, and said direction control valve assemblies are packaged in a common housing having a common return line to said reservoir, hydraulic lines leading to said limit valves, a hydraulic line leading to said motor, and hydraulic lines leading from said first and second hydraulic pump discharge lines to said first and second valve assemblies of said direction control valve.

20. An acceleration and direction control valve assembly for operating a reciprocating hydraulic mechanism comprising: a housing having a port for connection of a hydraulic return line leading to a hydraulic fluid reservoir; a continuous torque hydraulic motor mounted on said housing and having a shaft extending into said housing; stop-cam on said shaft including front and rear cam plates each having a peripheral stop surface arranged in tandem on one side of said cam; an index plate having a central opening therein around said cam including front and rear plate members aligned with said front and rear cam members, the inside edge of said index plate members each having a stop surface for engagement with said stop surfaces on said cam members, said index plate stop surfaces being spaced 180° apart for releasably engaging said cam at 180° intervals of rotation of said cam and said motor shaft; a pivot pin connected through said index plate into said housing along an axis parallel with said motor shaft pivotally mounting said index plate for movement along an arc between said first and second stop cam positions for engagement between said index plate stop surfaces and said cam stop surfaces for restraining said cam at said 180° intervals of rotation; said index plate having an operating lug extending outwardly radially along a side of said index plate opposite said pivot pin through said plate for pivoting said index plate on said pin between said first and second cam stop surface engaging positions; hydraulic pilot piston assemblies in said housing on opposite sides of said index plate lug, said pistons of said assemblies being engageable with opposite sides of said index plate lug for hydraulically pivoting said index plate between said stop cam positions, each of said pilot piston assemblies including means for connection of a hydraulic line for supplying hydraulic fluid to operate each of said piston assemblies for controlling said index plate; a scotch yoke assembly connected with said stop cam including a crank shaft secured on said cam extending along an axis spaced laterally from the axis of said cam on the side of said cam opposite from said motor shaft, a cross plate mounted on said crank shaft having an elongated slot receiving said crank shaft for reciprocating said cross plate in a direction perpendicular to the axis of said crank shaft as said crank shaft rotates with said stop cam, said cross plate having a bearing edge extending perpendicular to the axis of said crank shaft slot, and a guide block secured with said housing having a guide surface engageable by said guide surface of said cross plate for holding said cross plate to limit movement of said cross plate to straight line reciprocating motion as said cross plate is operated by said crank shaft on said cam; and a poppet valve assembly mounted on each of two opposite sides of said housing coupled with said scotch yoke cross plate for opening and closing said poppet valves responsive to reciprocating movement of said cross plate, said poppet valve assemblies each including a valve body opening into said housing for communication through said valve body and said housing to said hydraulic return line leading from said housing, each said valve body having a side port therein a valve seat mounted in said valve body having a bore therein and an annular valve seat on an inward end thereof, a poppet valve assembly mounted in in said body and said bore of said valve seat having an annular tapered poppet valve portion engageable with said valve seat for metering flow through said poppet valve as said poppet valve moves relative to said valve seat, a piston on said poppet valve for biasing said valve closed, said piston being movable in said valve seat outward of said side port in said valve body, and said poppet valve having means on an inward end thereof for coupling with said scotch yoke cross plate, said poppet valves being opened and closed by reciprocating movement of said cross plate, one of said valves being closed while the other of said valves is open.

21. A control valve assembly in accordance with claim 20 wherein said stop surfaces on said stop cam and on said index plate are formed in planes extending tangent to a circular arc drawn on an axis coincident with the axis of said pivot pin for said index plate.

22. A hydraulic power and control system for operating a reciprocating hydraulic mechanism comprising: a variable volume reversible hydraulic pump connected with said hydraulic mechanism for powering said mechanism in first and second directions; a constant volume hydraulic pump; a continuous torque hydraulic motor connected with said constant volume pump; a drive shaft connected with said continuous torque motor; an escapement connected with said drive shaft including a rotary cam on said drive shaft having a stop surface on the periphery thereof and an index plate around said cam mounted for pivotal movement relative to said cam, said index plate having stop surfaces engageable with said cam stop surface for restraining said cam at 180° intervals of rotation, and hydraulic pilot piston assemblies engageable with said index plate for pivoting said index plate between first and second positions for restraining said cam at said 180° intervals; a cam on a reciprocating member of said hydraulic mechanism; limit valves for engagement by said reciprocating member cam at first and second positions of said member; hydraulic line connections between said limit valves and said constant volume hydraulic pump; hydraulic line connections between said limit valves and said escapement pilot piston assemblies for operating said pilot piston assemblies responsive to hydraulic fluid pressure signals from said limit valves when said member reaches each of said first and second positions for moving said index plate between said first and second positions and restrain said index plate at one of said 180° intervals of rotation while said member moves in first and second directions; a rotary cam on said hydraulic motor shaft having a continuous cam groove; a cam follower in said cam groove; and an operating link between said cam follower and said reversible hydraulic pump for controlling the direction of operation and volume discharge of said pump responsive to said cam follower whereby said pump is operated to discharge hydraulic fluid to said hydraulic mechanism at one position of said index plate to operate said hydraulic mechanism in said first direction and to operate said reversible pump to discharge hydraulic fluid to said hydraulic device when said index plate is at the other of said positions for operating said hydraulic mechanism in said second direction.

23. A hydraulic power and control system in accordance with claim 22 wherein a hydraulic fluid metering valve is included in the line between said constant volume pump and said continuous torque motor for varying the speed of operation of said motor to control the acceleration and deceleration of said hydraulic mechanism when said device changes directions of operation.

24. A direction control device for a hydraulic power and control system comprising:

fluid direction control means having a fist position directing hydraulic fluid to move said hydraulic power and control system in one direction and a second position directing hydraulic fluid to move said hydraulic power and control system in the other direction; reversing means for shifting said fluids direction control means between said first and second positions; a continuous torque motor operatively connected to said reversing means; an escapement releaseably coupled with said motor to restrain said motor from operating said reversing means while said member is intermediate said first and second positions; and means for releasing said motor from said escapement responsive to arrival of said hydraulic power and control system at said first and at second positions allowing said motor to operate said reversing means and to shift said fluid direction control means between said first and said second operative positions.

25. A direction control device in accordance with claim 24 wherein said direction control means, said reversing means, and said hydraulic motor comprise a control valve assembly and further including: a shaft driven by said motor, a stop cam on said shaft having a latch surface thereon, an index plate mounted for movement relative to said stop cam and having spaced latch surfaces for engaging said cam latch surface at positions of rotation of said stop cam corresponding with said first and second positions of said fluid direction control means for restraining said stop cam while said member is intermediate said first and second positions and for releasing said stop cam to rotate for operating said reversing means; pilot pistons for engaging and operating said index plate between cam engaging positions and cam release positions responsive to arrival of said member at said first and second positions of said member, and said reversing means is connected with said motor shaft for reversing said direction control means when said cam is released and for holding said direction control means at one of said first and second positions when said stop cam is restrained by said index plate.

26. A hydraulic power and control system in accordance with claim 25 wherein said reversing means is a rotary cam having a continuous cam groove, a cam follower in said cam groove, and an operating arm connected between said cam follower for operating said direction control means.

27. A hydraulic power and control system in accordance with claim 25 wherein said reversing means is a scotch yoke assembly including a crank shaft on said stop cam, a cross plate coupled with said crank shaft for reciprocating movement as said stop cam rotates, and said direction control means is coupled with said cross plate.

28. A hydraulic power and control system in accordance with claim 27 where said direction control means comprises valve means opened and closed by said cross plate and connectible between pump means and a fluid reservoir of said hydraulic power and control system for selectively controlling discharge of hydraulic fluid from said pump means to hydraulic power mechanism.

29. A hydraulic power and control system in accordance with claim 28 wherein said stop cam comprises first and second cams in superimposed relation each having a stop surface thereon for engagement by said index plate to restrain said cam at 180° intervals of rotations and said index plate comprises first and second superimposed plates having aligned openings therein for receiving said stop cam and said first and second plates each having a stop surface engageable with the stop surfaces on the first and second cams, respectively, said index plate stop surfaces being spaced 180° apart.

30. A hydraul:c power and control system in accordance with claim 28 wherein said index plates are mounted for pivotal movement on a single pin and said stop surfaces on said index plates are aligned in planes perpendicular to a line drawn from said planes to the axis of pivotal movement of said index plates.

* * * * *